United States Patent [19]

Pezzulli

[11] Patent Number: 4,760,773

[45] Date of Patent: Aug. 2, 1988

[54] VENTILATOR CLOSURE

[76] Inventor: Michael F. Pezzulli, 717 N. Harwood St.; Suite 1200, Dallas, Tex. 75201

[21] Appl. No.: 931,403

[22] Filed: Nov. 17, 1986

[51] Int. Cl.[4] ..... F24F 7/02

[52] U.S. Cl. ..... 98/42.16; 98/75; 98/119

[58] Field of Search ..... 98/41.3, 42.16, 42.20, 98/75, 119

[56] References Cited

U.S. PATENT DOCUMENTS

| | | | |
|---|---|---|---|
| 827,603 | 7/1906 | Quette et al. | 98/41.3 |
| 842,538 | 1/1907 | Elward | 98/41.3 |
| 2,525,371 | 10/1950 | Reynolds | 98/41.3 |
| 2,936,692 | 5/1960 | White | 98/43.3 |
| 3,830,146 | 8/1974 | Kaiser | 98/41.3 |
| 4,123,001 | 10/1978 | Kolt | 98/72 |
| 4,231,288 | 11/1980 | Finley | 98/72 |
| 4,287,816 | 9/1981 | Riccard | 98/119 |
| 4,374,534 | 2/1983 | Jespers et al. | 98/75 |
| 4,505,189 | 3/1985 | Morris et al. | 98/41.3 |

*Primary Examiner*—Larry I. Schwartz

*Attorney, Agent, or Firm*—Thomas L. Crisman

[57] ABSTRACT

A roof ventilator closure assembly for mounting under a roof and including a door which slides within a framework to selectively cover and uncover an opening in the framework positioned in registry with the ventilator opening in the roof. The opening in the framework is covered by screen material to prevent the entry of insects and animals through the ventilator when the framework opening is uncovered by the door.

7 Claims, 2 Drawing Sheets

VENTILATOR CLOSURE

BACKGROUND OF THE INVENTION

1. Field of the Invention

The invention relates to a closure means for a roof ventilator and, more particularly, to a frame-work and sliding door assembly for selectively closing roof ventilation openings.

2. History of the Prior Art

Many buildings include means for ventilating the air space within an attic to the outside atmosphere in order to dissipate moisture contained in the air within the attic, as well as to dissipate heat trapped in the attic space during hot weather. Such ventilation means may include a louvered window-like opening in the gable portion of the roof or at the end of the roof as well as conventional wind-driven turbine type ventilators which are mounted on the roof. Turbine type generators are rotated by the wind and serve to withdraw by turbine effect stagnant air from within the attic space and discharge it into the atmosphere. Fresh air from the outside then moves in through the louvered windows in the gables to replace the air in the attic space with fresh, cooler air.

Wind-turbine type roof ventilators are very effective in the cooling of a home during the summer months by removing the hot air which collects in the attic space beneath the surface of the roof. However, during the winter months, attic ventilators are not needed to discharge warm, stagnant air within the attic and, moreover, such ventilation contributes to a tremendous amount of heat loss from the attic space. This makes it much more difficult to efficiently warm the home during the winter months. Thus, it is desirable to close both wind turbine type vents as well as louvered window vents during winter months in order to maximize the efficiency of heating of a building.

A further problem associated with attic ventilation is that insects, such as wasps, as well as animals such as squirrels, chipmunks, and even domestic animals such as cats, may find entry into the attic of a building through either the louvered ventilation windows or by means of the interstices between adjacent blades of a turbine ventilator. Once an animal has received access to the attic it may cause damage to the insulation or wiring in the attic or be unable to escape from the attic and die there creating an olfactory nuisance for the occupants. In addition, the running and thrashing about of animals within an attic space can also be very disturbing to the occupants of a dwelling. Needless to say, the presence of wasps and other undesirable insects in the attic make it difficult to use the space for storage or other useful domestic purposes.

It has been recognized that it is desirable to close the ventilation openings of a wind turbine type attic ventilator during the winter months to conserve heat loss. In particular, U.S. Pat. No. 4,374,534 discloses a bag-like cover for encapsulating the entire turbine in order to reduce the heat loss from the turbine when ventilation is not required. Similarly, U.S. Pat. No. 4,231,288 discloses a disk-like closure member which is spring biased against the inside opening of a wind turbine beneath the roof in order to seal that opening during the cold months of the year and prevent heat loss from the dwelling through the opening. In addition, other patents such as U.S. Pat. No. 4,123,001, have taught damper, either operated by either temperature or pressure or both, located within the interior of the turbine ventilator in order to automatically vary the opening of the ventilator depending on environmental conditions.

Use of an exterior turbine cover requires that someone climb onto the outside of the roof in order to apply the cover which is often a dangerous operation. The disk-like seal is relatively cumbersome to apply since it is not an integral unit and must also be removed and put away during the warm months rather than being a permanent fixture to be installed at the time the turbine is installed. Moreover, none of these prior art devices also serve to prevent the entry of animals or insects and prevent their nesting within the attic of the building while at the same time provide for the selective closing of the opening beneath the ventilator as seasonally required.

The assembly of the present invention is a unitary structure which overcomes the disadvantages of the prior art by providing in a single assembly a means for preventing the entry and egress of animals and insects through the ventilation openings, while at the same time allowing the selective opening and closure of the ventilation means as required by the seasons.

SUMMARY OF THE INVENTION

The invention includes a roof ventilation closure assembly consisting of an elongate plate member having opposed parallel tracks formed along opposed edges. An opening is formed in the plate member at one end and a door member is positioned adjacent the surface of the plate which has opposed edges engaging the parallel tracks for sliding movement along the plate member and selective opening and closing of the opening in the plate. The closure assembly also includes means for restraining the movement of the door past one end of the plate and means for mounting the surface of the plate opposite the door adjacent the interior opening of a ventilation means of a roof structure with the opening of the plate in alignment ventilation opening to permit the selective opening and closing of the air passageway of the ventilation means by the slidable movement of the door.

In another aspect the invention includes a roof ventilation closure assembly wherein the plate includes a screen wire covering across the opening therein to prevent the entry of animals and insects through the ventilation means. In still a further aspect the invention contemplates a roof ventilation closure assembly wherein the opening is circular and wherein the side of said plate opposite the door also includes a cylindrical segment for being received into the interior of a cylindrical turbine passageway.

BRIEF DESCRIPTION OF THE DRAWING

For a more complete understanding of the present invention and for further objects and advantages thereof reference may be had to the following detailed description taken in conjunction with the accompanying drawings in which.

DETAILED DESCRIPTION OF THE PREFERRED EMBODIMENT

Figure 1:
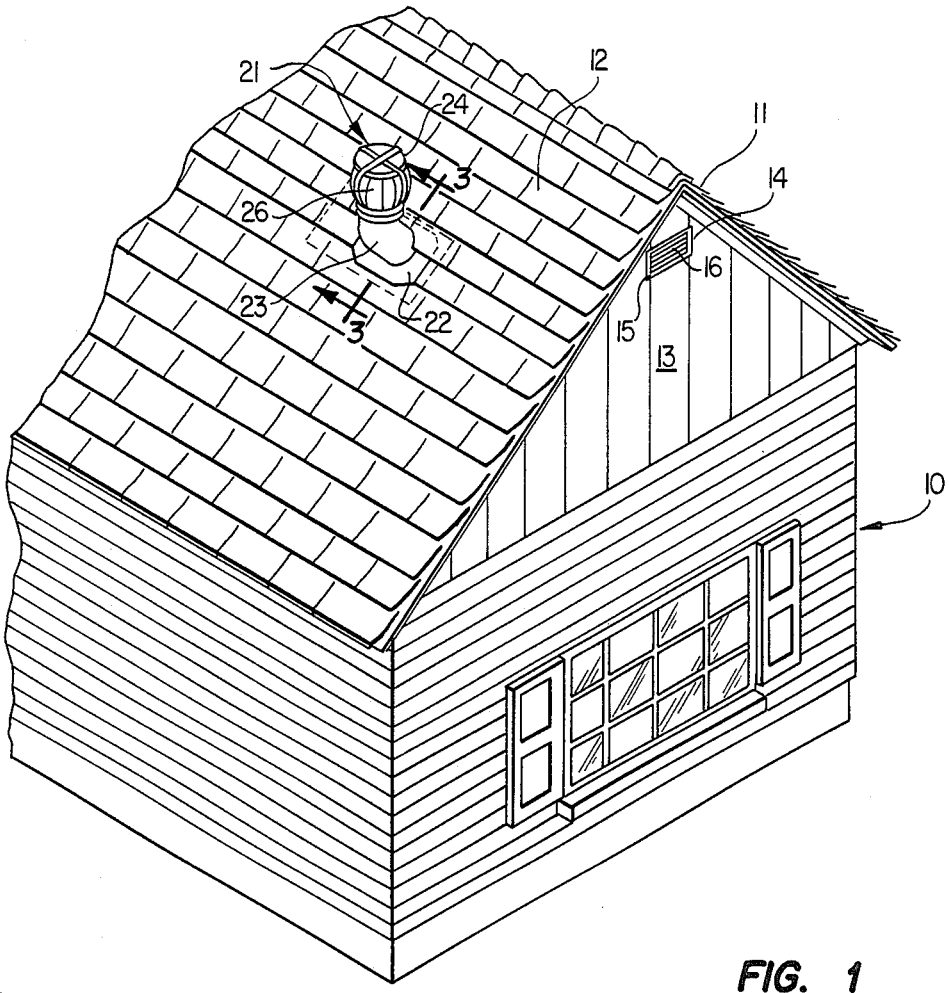
FIG. 1 is a perspective view of a building illustrating a louvered window type ventilator and a wind turbine type ventilator.

Referring first to FIG. 1 there is shown a partial perspective view of a building 10 having roof surfaces 11 and 12 above a gable 13. Defined by the roof surface 11 and 12 and the gable 13 is a hollow interior attic space directly above the interior ceiling of the building 10.

The interior attic space of the building 10 is ventilated by means of a louvered gable window 14 which comprises a framed opening 15 in the gabled portion 13 of the roof which is partially closed by angulated slats or louvers 16 which allow air to pass into the opening 15 while excluding rain and larger animals.

Upon the top surface of the roof surface 12 there is mounted a wind turbine type ventilator 21 which comprises a radially outwardly extending flange 22 which mounts an upwardly extending tubular conduit 23 with a wind turbine 24 rotatably mounted at the upper end. A portion of the shingles 25 overlie the upper portion of the flange 22 to seal the interface of the assembly with the roof against leakages from rain and other moisture.

The turbine 24 is rotatably mounted to the upper end of the tubular member 23 so that as the wind blows against the angulated vanes 26, the turbine 24 is caused to rotate. Rotation of the vanes 26 pulls air from within the tubular member 23 and thereby the interior of the attic space and exhausts the air drawn from the attic into the atmosphere. Fresh air is then drawn into the attic space through the louvered gabled window 14 which cools the attic and reduces the temperature within the rooms of the building 10.

A problem which is encountered with both the gable ventilation window 14 and the roof turbine 21 is that small animals, such as birds, squirrels and the like, as well as insects such as wasps, may enter into the attic space through the spaces between the louvers 16 of the gable window 14 and through the spaces between adjacent ones of the blades 26 of the wind turbine 21. These animals and insects form nests in the attic portion of the building 10 and create a nuisance to the occupants by causing damage to the interior of the building or preventing any use of attic space for storage, due to the presence of wasps, for example.

Another problem which is inherent in such ventilation systems is that during the winter months a tremendous amount of heat is lost from the rooms of the building 10 to the attic space due to the fact that the ventilation means allow cold outside air to enter the attic and reduce the temperature. Thus, it is desirable to provide a means for screening the interior openings of the ventilation means against entry by animals and insects as well as provide a means for selectively closing the ventilation means to the outside during winter months in order to prevent heat loss.

Figure 2:
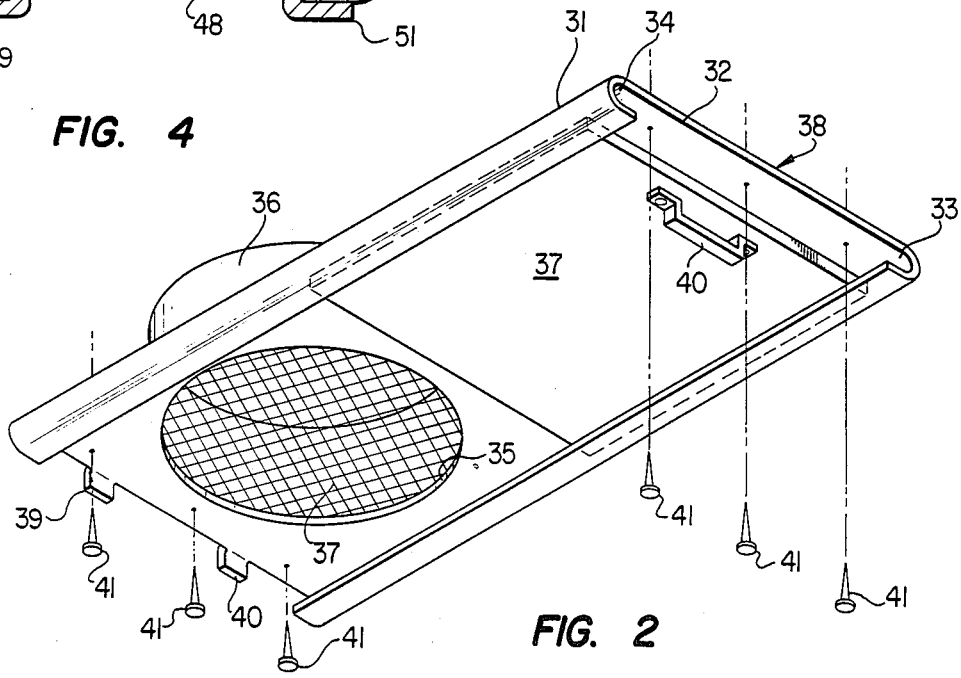
FIG. 2 is a partially-exploded perspective view of the lower side of one embodiment of the assembly of the present invention.

Referring now to FIG. 2, there is shown a lower perspective view of a ventilator closure assembly 31 constructed in accordance with the teaching of the present invention. The assembly 31 comprises a unitary structure for direct mounting to the underside of the roof providing screening against entry of insects and animals by means of the ventilation openings and a means for selectively closing the ventilation openings during the winter months.

The assembly 31 comprises a generally flat rectangular sheet or plate 32 having rolled U-shaped edges 33 and 34 along opposed sides thereof. A circular opening 35 is formed in a central portion of the plate 32 at one end. A cylindrical turbine receiving sleeve 36 is mounted to the upper surface of the plate 32 engaging the edges of the circular opening 35. A screen wire 37 extends across the circular opening 35 on the upper side of the plate 32.

Mounted adjacent the underside of the plate 32 and received by the rolled edges 33 and 34 is a flat, generally rectangular sliding door 37. The door 37 is mounted for sliding movement from one end of the plate 32 to the other within the tracks formed by the U-shaped edges 33 and 34. The door 37 can be inserted into the open ends of the rolled edges 33 and 34 through the open end 38 and is restrained from movement out the other end by means of upstanding tabs 39 and 40 at the end of the plate 32 adjacent the central circular opening 35. The plate 32 is mounted to the underside of the roof by means of attachment devices such as screws, nails or other means, illustrated by nails 41. The door 37 may be slid along the track formed by the rolled edges 33 and 34 by means of a handle 40 mounted to one end.

Figure 3:
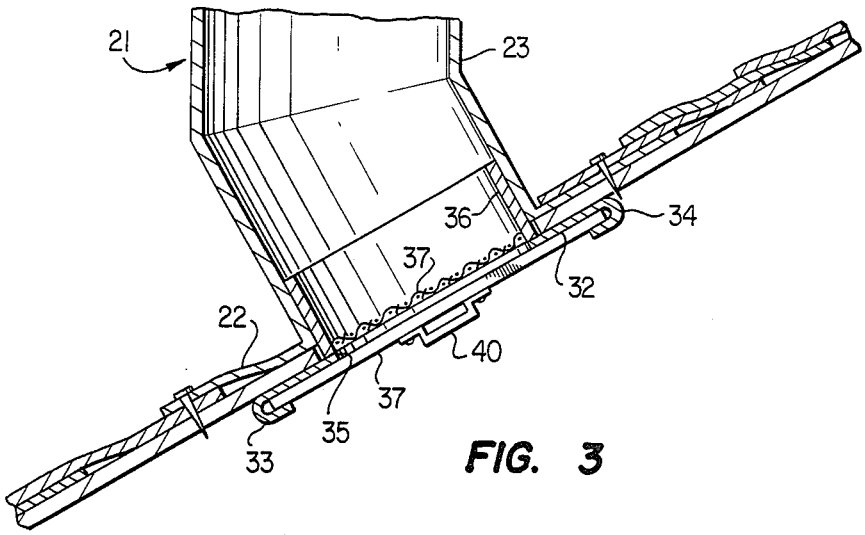
FIG. 3 is a cross-section view taken along lines 3—3 of FIG. 1.

Referring to FIG. 3 there is shown a cross-section view of the closure assembly of the present invention mounted to the underside of the roof. The cylindrical turbine receiving flange fits up into the inside of the cylindrical tubing 23 of the wind turbine 21 and is snuggly received therein. Wind turbines come in various diameters so that a particular turbine is paired with a closure assembly 31 having a mating diameter of cylindrical internal flange 36. The screen 37 serves to close the opening of the turbine to the interior of the roof space to prevent the entry of animals and insects from the outside into the attic space through the turbine. Similarly, the door 37 may be slid by means of the handle 40 along the tracks formed by the U-shaped members 33 and 34 to position it to either partially close the opening 35 or leave the opening 35 totally unobstructed for maximum flow of air through the turbine conduit 23.

Figure 4:
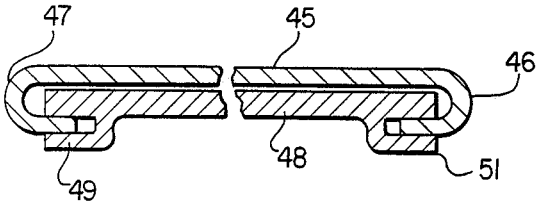
FIG. 4 is a cross-section view showing an alternate embodiment of the assembly of the present invention.

Referring briefly to FIG. 4 there is shown an alternate embodiment of a closure assembly which includes a rectangular plate 45 having similar rolled edges 46 and 47. The door member, however, includes a door plate 48 having opposed edge surfaces which include bifurcated edges comprising elongate flanges 49 and 51 running the length of the door. The flanges 49 and 51 form a channel into which is received the edge of the U-shaped edges 46 and 47 and provide accurate tracking means for the sliding of the door 48 along the length of the plate-like frame 45.

Figure 5:
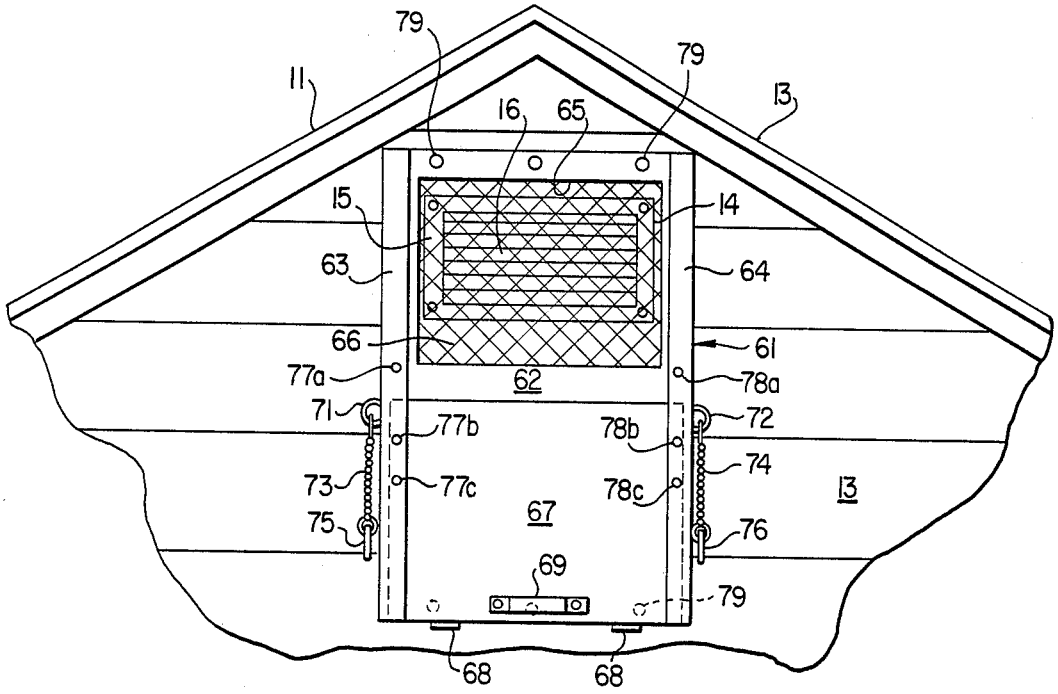
FIG. 5 shows a plan view of a louvered window ventilator from within the attic having an alternate embodiment of the invention mounted thereon.

Referring next to FIG. 5, there is shown an interior view of the gable portion of the roof from within the attic of the house 10. The gable window 14 having a rectangular opening 15 and a plurality of louver-like slats 16 is covered over on the inside surface by means of a closure frame assembly 61 constructed in accordance with another embodiment of the teachings of the present invention. Frame 61 includes a rectangular plate 62 having a pair of rolled edge sections 63 and 64 along opposed side walls. An opening 65 in the surface of the plate 62 is located at one end and overlies the extent of the opening 15 of the gable ventilation opening 14. A section of screen wire 66 overlies the opening 65 on the undersurface thereof to prevent the entry of insects and/or animals through the gable window 14.

A rectangular door 67 is mounted for slidable movement along the tracks formed by the rolled edge sections 63 and 64 in the vertical direction to selectively close all or a portion of the opening 65 and prevent the flow of air to and/or from the attic by means of the gable opening 14. The door 67 is restrained from downward movement from within the tracks 63 and 64 by means of a pair of upstanding tabs 68 at the lower end of the frame 61. A handle 69 enables the movement of the door 67 along the track 63 and 64. The door 67 is shown in the fully open position in FIG. 5. Along the outer edges of the tracks 63 and 64 are mounted, respectively a pair of rings 71 and 72 to which are attached chains 73 and 74 respectively, at the ends of which are attached pins 75 and 76. Along the upper surface of the rolled edge sections 63 and 64 are formed a plurality of holes 77*a*–77*c* and 78*a*–78*c*. When the door 67 is raised upwardly by means of the handle 69, the door may be held in one position by insertion of the pin 75 and 76 into a selected one of the openings 77*a*–77*c* and 78*a*–78*c* to hold the door in position. Insertion of the pin into 77*a* and 78*a* holds the door 67 to fully close the opening 65 and prevent any movement of air therethrough. Positioning of the pins in openings 77*b* and 78*b* closes half of the opening 65 while the positioning of the pins in the openings 77*c* and 78*c* closes only a small portion of the opening allowing a selected amount of circulation. In this manner, some circulation may be allowed while preventing a severe loss of heat from the interior of the attic space. The frame 61 is held in position against the interior wall of the gable 13 by means of a plurality of fastening means such as screws or bolts 79 at both ends of the framework 61.

Figure 6:
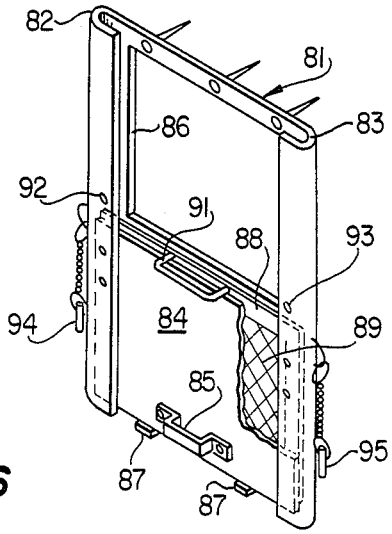
FIG. 6 shows a partially cut-away perspective view of the embodiment of the invention shown in FIG. 5.

Referring now to FIG. 6 there is shown a further alternate embodiment of the closure means of FIG. 5. The assembly comprises a similar framework 81 having a pair of rolled edges 82 and 83 formed along the rectangular surface thereof and within which is moveable a plate-like door 84 by means of a handle 85. Similarly, there is included a rectangular opening 86 located at one end of the framework 81 for positioning over the inside of the roof opening to be selectively closed in a manner similar to the embodiment shown in FIG. 5. The door 84 is prevented from movement in the lower direction by means of a pair of tab members 87 at the lower end. In addition, there is also shown a second rectangular frame 88, also mounted for slidable movement upon the tracks formed by the rolled edge sections 82 and 83. The frame 88 includes a screen wire member 89 and a handle 91 located at the upper end. Thus, by upward movement of the handle 91 the frame 88 can be moved into position thereby covering the opening 86 with the screen wire portion to allow air to circulate but prevent the entry of insects and animals through the opening while at the same time allowing the screen to be lowered for full access to the roof opening whenever necessary. Similarly, when the screen frame 88 is in the upward position covering the opening 86, the door 84 can also be raised to position it partially overlying the screen portion and close off circulation of air through the vent member. The frame 81 also includes a plurality of holes 92 and 93 along the opposed rolled edges 82 and 83 for positioning of pins 94 and 95 and selectively position either one of the screen door 88 or the full closure door 84 across the opening 86 in any one of a plurality of selectively open or closed positions.

It should be understood that the parts of the present invention may be made either by molded plastic or by means of formed sheet metal or by any other appropriate means.

While particular embodiments of the invention have been described, it is obvious that changes and modifications may be made thereon and still remain within the scope and spirit of the present invention. It is the intent that the appended claims cover all such changes and modifications.

What is claimed is:

1. A roof ventilation closure assembly comprising:

an elongate plate member having opposed parallel tracks formed along opposed edges;

an opening formed in said plate member at one end thereof;

a door member positioned adjacent the surface of said plate and having opposed edges engaging the parallel tracks for slidable movement along said plate member for selective opening and closing of the opening in said plate, the tracks formed along opposed edges of said elongate plate member extending the entire length of slidable movement of said door member to provide stability and guidance thereto over its full range of movement;

means for restraining the movement of said door past one end of said plate; and means for mounting the surface of said plate opposite said door adjacent the interior opening of a ventilation means of a roof structure with the opening of the plate in alignment therewith to permit the selective opening and closing of the air passageway of the ventilation means with the slidable movement of said door.

2. A roof ventilation closure assembly as set forth in claim 1 wherein said plate includes a screen wire covering across said opening therein to prevent the entry of animals and insects through the ventilation means.

3. A roof ventilation closure assembly as set forth in claim 1 wherein said opening is circular and wherein the side of said plate opposite said door also includes a cylindrical segment for being received into the interior of an air turbine passageway.

4. A roof ventilation closure assembly as set forth in claim 1 which also includes a frame member mounted for slidable movement along said tracks which includes an opening and a screen wire covering across said opening for selective movement into and out of engagement with the opening in said frame member.

5. A roof ventilation closure assembly as set forth in claim 1 wherein said plate is formed of sheet metal and wherein said tracks are formed by rolled U-shaped edge sections.

6. A roof ventilation closure assembly as set forth in claim 5 which also includes:

a plurality of apertures formed spaced from one another along said rolled edges; and a pin for engaging a selected one of said apertures to prevent the movement of said door more than a selected distance across said opening in the plate.

7. A roof ventilation closure assembly as set forth in claim 5 in which the opposed edges of said door include bifurcated flanges which engage the edge of said rolled sections for slidable movement of said door along said plate.

* * * * *